United States Patent [19]

Alme

[11] 3,993,004

[45] Nov. 23, 1976

[54] REMOVABLE AND TILTABLE TABLE TOP

[75] Inventor: Allyn C. Alme, Elgin, Ill.

[73] Assignee: Johnson Industries, Elgin, Ill.

[22] Filed: Dec. 11, 1974

[21] Appl. No.: 531,455

[52] U.S. Cl. ..... 108/124; 108/150; 108/157

[51] Int. Cl.[2] ..... A47B 3/00

[58] Field of Search ..... 108/1, 6, 8, 15, 150, 108/153, 157, 115, 124; 248/371, 284, 286

[56] References Cited

UNITED STATES PATENTS

| | | | |
|---|---|---|---|
| 1,792,406 | 2/1931 | Tomlinson | 108/157 |
| 2,686,094 | 8/1954 | Terry | 108/157 |
| 3,113,531 | 12/1963 | Barnard | 108/6 |

*Primary Examiner*—Roy D. Frazier
*Assistant Examiner*—Darrell Marquette
*Attorney, Agent, or Firm*—Edmond T. Patnaude

[57] ABSTRACT

A table top is pivotably attached to a pedestal for movement between a horizontal position and a substantially vertical position wherein the top can be removed from the pedestal.

7 Claims, 5 Drawing Figures

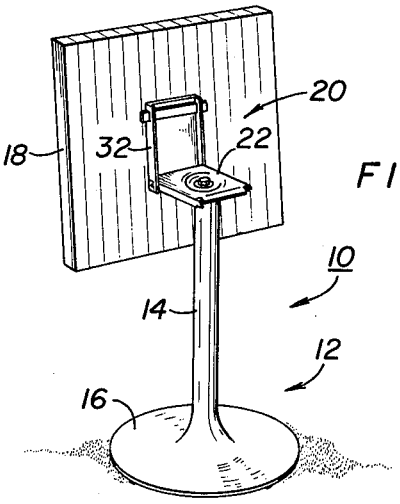
FIG. 1
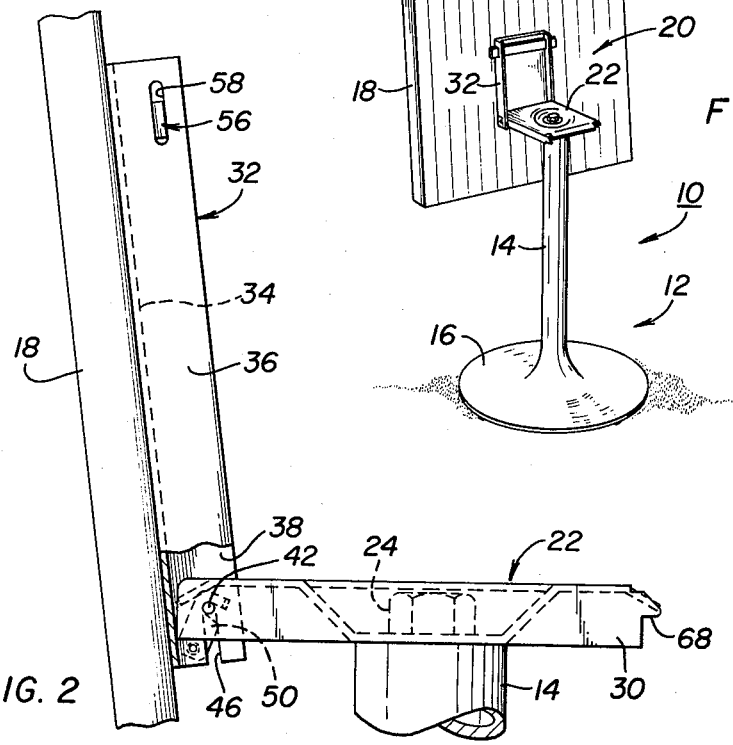
FIG. 2
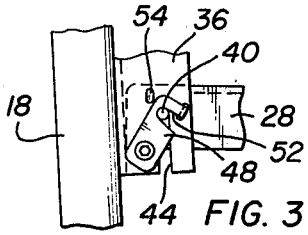
FIG. 3
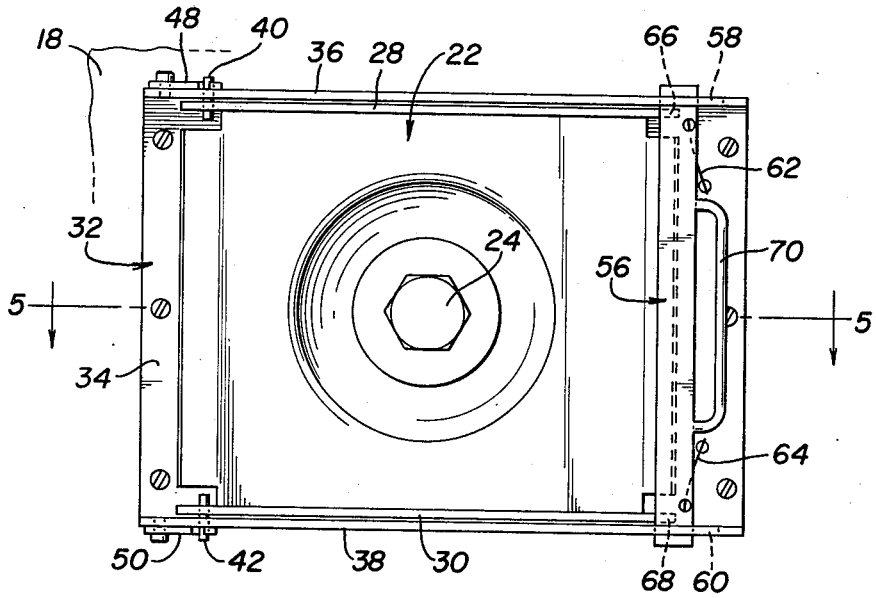
FIG. 4
FIG. 5
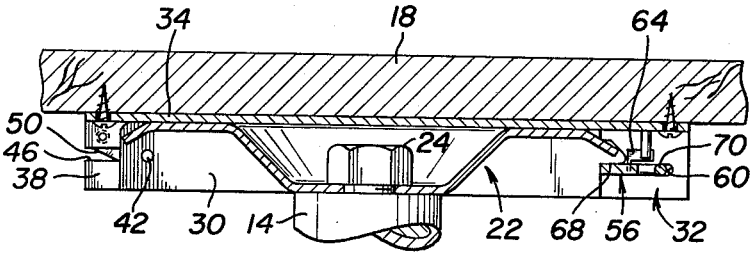

REMOVABLE AND TILTABLE TABLE TOP

The present invention relates in general to tables, and it relates in particular to a table having a pivotable and removable top.

BACKGROUND OF THE INVENTION

For many uses it is particularly desireable that tables have pivotable tops so that less space is required to store the tables when not in use. Where the tables will not be used for extended periods it would be desireable for the tops to be easily removable for even greater compact storage.

OBJECTS OF THE INVENTION

Therefore, a principal object of the present invention is to provide a new and improved mechanism for pivotably and removably attaching a table top to a table base.

Another object of this invention is to provide a table wherein the top may be easily pivoted to a substantially vertical position or may be removed from the base, such mechanism being durable in construction and providing a strong rigid connection between the top and the base.

SUMMARY OF THE INVENTION

Briefly, the above and further objects may be realized in accordance with the present invention by providing a pair of pivotally connected members respectively attached to a table base and to a table top by a mechanism which also permits removal of the top from the base when the top is in a substantially vertical position.

BRIEF DESCRIPTION OF THE DRAWING

Further objects and advantages and a better understanding of the present invention can be had by reference to the following detailed description, wherein;

FIG. 1 is a perspective view of a pedestal type table embodying the present invention, the table top being shown in a nearly vertical, storage position;

FIG. 2 is a fragmentary elevational view, partly in section, of the means connecting the table top to the base;

FIG. 3 is an elevational view of the latching mechanism used to hold the pivotable connecting members in mutually assembled relationship;

FIG. 4 is a bottom view of the mechanism which connects the table top to the base; and FIG. 5 is a sectional view taken along the line 5—5 of FIG. 4.

DETAILED DESCRIPTION OF THE INVENTION

Referring to FIG. 1, a table 10 comprises a pedestal base 12 having a central vertical post 14 extending upwardly from a base portion 16 which is adopted to rest on a floor. A table top member 18 is mounted to the top of the post 14 by a mechanism or assembly 20 which permits pivoting of the top 18 between a horizontal position of use and the substantially vertical position shown in FIGS. 1 and 2. When in the latter position a plurality of the tables may be stored side by side.

The mechanism 20 includes a first member 22 having a depressed central area receiving a bolt 24 threaded into a threaded hole in the top of the post 14 to secure the member 22 of the post. Other means for securing the member 22 to the table base may be used without departing from the present invention. The member 22 is generally channel shaped having a flat web portion 26 and depending side flanges 28 and 30. A second channel shaped member 32 has a flat web portion 34 which lies against the bottom central surface of the table top 18 and is suitably fixed thereto as by screws or other suitable means. The member 32 has a pair of side flanges 36 and 38 which are spaced apart by a distance slightly greater than the distance between the outside surfaces of the flanges 28 and 30 so that when the table top is in the horizontal position as shown in FIG. 5, the member 22 is nested within the member 32. The side flanges of the members 22 and 32 are closely interfitted so as to prevent relative rotation between the table top and the base.

In order to permit tilting of the table top 18 between the horizontal and vertical positions, a pair of pintle members of pivot pins 40 and 42 are press fitted in mutual alignment in holes near the ends of the flanges 28 and 30 and extend outwardly therefrom into openings 44 and 46 respectively in the flanges 36 and 38. The openings 44 and 46 are slots each having a width slightly greater than the diameter of the associated pintle and the slots open onto the ends of the flanges 36 and 38. A pair of clip members 48 and 50 are pivotally attached to the flanges 36 and 38 between the slots and the web 34. The clip members are identical and each has a tapered slot 52 therein for receiving a respective one of the pintles 40 and 42 to pivotally secure the members 22 and 32 together. In order to remove the table top from the base, with the top 18 in the vertical position the clips 48 and 50 are moved away from the pintles 40 and 42 and the top 18 is simply lifted off the base. As more fully explained hereinafter, when the table top 18 is in the storage position as illustrated in FIGS. 1, 2 and 3 it is held there by gravity with the ends of the flanges 28 and 30 adjacent the pintles providing stops against which the web 34 abuts.

Since the table top 18 is offset from the vertical when in the storage position, when the clips 48 and 50 are pivoted against the underside of the table top 18 they are also retained in that position by gravity. Nevertheless, a raised detent 54 is provided in each of the flanges 36 and 38 between the latched and unlatched positions of the latches 48 and 50 to prevent spurious movement of the latches from one position to the other. If desired, an overcenter spring could also be used for this purpose.

For the purpose of locking the table top to the pedestal in the horizontal position of normal use, a locking bar 56 is mounted for limited, horizontal sliding movement in a pair of elongated slots 58 and 60 in the flanges 36 and 38 near the end of the member 26 opposite the pintles. The bar 56 is resilently biased by means of a pair of leaf springs 62 and 64 into a locking position wherein it lies beneath a pair of lugs 66 and 68 extending from the ends of the flanges 28 and 30. As best shown in FIG. 5 the upper edge surfaces of the lugs 66 and 68 are tapered so that when the top 18 is lowered into the horizontal position the locking bar automatically locks the members 22 and 32 in the nested, juxtaposed positions. A bail-like handle 70 is provided on the bar 56 to facilitate releasing the lock so as to permit pivoting of the top 18 into the storage position.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. In a table of the type having a base and a central upstanding post supporting a table top thereon, the improvement residing in the means mounting said table top to said post and comprising a first member fixedly secured to said post and centrally disposed on the top thereof, a second member fixedly secured to the bottom of said table top in such manner as to rest on said first member when said table top is in a substantially horizontal position, said second member having a plurality of parallel slots having top and bottom surfaces lying substantially parallel to the plane of said table top, said slots opening at one side end of said second member and terminating in closed ends a substantial distance from the center line of said table top, said first member having a plurality of pintle portions arranged in mutual coaxial relationship and extending respectively into said slots to pivotally connect said members together, latch means carried by one of said members for releasably holding said pintle portions in said slots, and locking means for releasably locking said first and second members in mutually juxtaposed positions with said second member resting on said first member.

2. The invention according to claim 1 wherein said first and second members are channels with said second member being interfitted in said first member.

3. The invention according to claim 2 wherein said members have web portions which mutually abut when said table top is in the horizontal position, and depending side flanges which prevent relative rotation between said members when said table top is in a horizontal position.

4. The invention according to claim 3 wherein said locking means comprises a horizontally disposed bar carried by said second member and having end portions extending through elongated slots in the side flanges of said second member, spring means urging said bar toward one end of each of said elongated slots, and lug portions on the flanges of said first member extending between said bar and the web of said second member when said bar is disposed at said one end of said elongated slots.

5. The invention according to claim 1 wherein is provided stop means against which said table top is held by gravity when said second member is in a substantially vertical storage position against said stop means.

6. The invention according to claim 1 wherein said latch means comprises a pair of latches pivotally mounted to said one of said members.

7. The invention according to claim 6 comprising detent means for holding said latches in either a latched or unlatched position.

* * * * *